US008701366B2

(12) United States Patent
Oberg

(10) Patent No.: US 8,701,366 B2
(45) **Date of Patent: *Apr. 22, 2014**

(54) INSULATED METAL ROOFING SYSTEMS AND RELATED METHODS

(76) Inventor: Craig Oberg, Ephraim, UT (US)

( * ) Notice: Subject to any disclaimer, the term of this patent is extended or adjusted under 35 U.S.C. 154(b) by 492 days.

This patent is subject to a terminal disclaimer.

(21) Appl. No.: 12/995,147

(22) PCT Filed: May 27, 2009

(86) PCT No.: PCT/US2009/045323

§ 371 (c)(1),
(2), (4) Date: Feb. 28, 2011

(87) PCT Pub. No.: WO2009/154996

PCT Pub. Date: Dec. 23, 2009

(65) Prior Publication Data

US 2011/0154769 A1 Jun. 30, 2011

Related U.S. Application Data

(60) Provisional application No. 61/056,147, filed on May 27, 2008.

(51) Int. Cl.

| | |
|---|---|
| ***E04B 7/00*** | (2006.01) |
| ***E04B 9/00*** | (2006.01) |
| ***E04B 7/22*** | (2006.01) |
| ***E04B 1/74*** | (2006.01) |

(52) U.S. Cl.
USPC ..... 52/404.1; 52/406.1; 52/407.1; 52/407.3; 52/404.5; 52/309.4; 52/309.8; 52/309.15

(58) Field of Classification Search
USPC ..... 52/404.1–404.3, 407.3–407.5, 52/408–410, 478–479, 483.1, 287.1, 52/288.1, 309.4, 309.8, 309.15, 309.16
See application file for complete search history.

(56) References Cited

U.S. PATENT DOCUMENTS 3,996,834 A * 12/1976 Reynolds ..... 411/436
4,058,949 A * 11/1977 Bellem ..... 52/407.1

(Continued)

FOREIGN PATENT DOCUMENTS

EP 0953693 11/1999
JP 10-131411 5/1998

(Continued)

OTHER PUBLICATIONS

U.S. Appl. No. 12/977,930, filed Dec. 23, 2010; Craig Oberg.

(Continued)

*Primary Examiner* — Jeanette E. Chapman
(74) *Attorney, Agent, or Firm* — Thorpe North & Western LLP

(57) ABSTRACT

An insulated roof deck system which can be used in installing metal roofs is set forth. The system includes a plurality of metal purlins (10), a plurality of metal roof panels (2), a plurality of thermal insulation blocks (4), cleats (14), and threaded fasteners (12). The metal purlins (10) can form a parallel array of purlins. The metal roof panels (2) can be attached to the metal purlins (10) in the parallel array. The thermal insulation blocks (4) can be disposed between the metal purlin (10) and the metal roof panel (2). The cleat (14) can be disposed between the thermal insulation blocks (4) and the metal roof panel (2) and has a protrusion which is capable of securing the thermal insulation block (4) and inhibits lateral movement between the thermal insulation block (4) and the cleat (14). The threaded fastener (12) secures the metal roof panel (2), the cleat (14), and the thermal insulation block (4) to the metal purlin (10). The threaded fastener (12) can include one or more unthreaded regions sufficient to reduce or prevent over-tightening during use.

18 Claims, 2 Drawing Sheets

(56) References Cited

U.S. PATENT DOCUMENTS

| | | | | |
|---|---|---|---|---|
| 4,346,543 | A * | 8/1982 | Wilson et al. | 52/404.2 |
| 4,449,343 | A * | 5/1984 | Henningsen | 52/404.1 |
| 4,651,489 | A * | 3/1987 | Hodges et al. | 52/409 |
| 4,735,026 | A | 4/1988 | Forsythe | |
| 4,736,561 | A | 4/1988 | Lehr et al. | |
| 4,930,285 | A | 6/1990 | Ward | |
| 5,095,673 | A | 3/1992 | Ward | |
| 5,561,959 | A * | 10/1996 | Alderman et al. | 52/407.3 |
| 5,636,487 | A | 6/1997 | Fligg | |
| 6,487,800 | B1 | 12/2002 | Evans et al. | |
| 6,513,295 | B2 * | 2/2003 | Bernardino | 52/506.09 |
| 6,666,638 | B2 * | 12/2003 | Craven | 411/413 |
| 7,357,353 | B2 * | 4/2008 | Stephens | 244/123.1 |
| 8,316,605 | B2 * | 11/2012 | Oberg | 52/404.1 |
| 2003/0167718 | A1 * | 9/2003 | Alderman | 52/407.3 |
| 2008/0083183 | A1 | 4/2008 | Rymell et al. | |
| 2008/0110123 | A1 | 5/2008 | Oberoi et al. | |
| 2011/0078973 | A1 | 4/2011 | Oberg | |

FOREIGN PATENT DOCUMENTS

| | | |
|---|---|---|
| JP | 2001-032458 | 2/2001 |
| KR | 20-1987-0001731 | 5/1987 |
| WO | WO 2007/057870 | 5/2007 |

OTHER PUBLICATIONS

PCT Application PCT/US2009/045323; filed May 27, 2009; Craig Oberg; ISR mailed Dec. 28, 2011.

PCT Application PCT/US2010/051682; filed Oct. 6, 2010; Craig Oberg; International Search Report mailed Jun. 29, 2011.

U.S. Appl. No. 12/899,399, filed Oct. 6, 2010; Craig Oberg; office action mailed Mar. 21, 2012.

* cited by examiner

INSULATED METAL ROOFING SYSTEMS AND RELATED METHODS

RELATED APPLICATIONS

This application is a U.S. national stage entry of PCT International Application No. PCT/US2009/045323, filed 27 May 2009, which claims priority to U.S. Provisional Patent Application 61/056,147, filed 27 May 2008.

FIELD OF THE INVENTION

The present invention relates generally to insulated metal roofing systems and associated methods.

BACKGROUND

Metal roofs are well known and have been used for many years in commercial and industrial-type buildings. Typically, such roofs are constructed of parallel spaced joists or purlins over which are placed the various other components of the roof, including the metal roof deck. As energy efficiency standards have increased, new government requirements have forced metal roof manufacturers and installers to increase the amounts, types, and location of insulation used in the roofs, including the requirement of placing a thermal insulation block between the metal purlin and the metal roof deck. Unfortunately, some new insulation requirements can weaken or lessen the lateral strength of the roof deck. Accordingly, research continues into roofing systems which comply with all government requirements but which do not suffer from reduced lateral strength.

SUMMARY OF THE INVENTION

The present invention provides for an insulated roof deck system which can be used in installing metal roofs. The system includes a plurality of metal purlins, a plurality of metal roof panels, a plurality of thermal insulation blocks, cleats, and threaded fasteners. The metal purlins can be configured to form a parallel array of purlins such that voids exist between the metal purlins in the parallel array. The metal roof panels can be configured to be attached to the metal purlins in the parallel array. The thermal insulation blocks can be configured to be disposed between the metal purlin and the metal roof panel. The cleats can be configured to be disposed between the thermal insulation blocks and the metal roof panel and can have a protrusion which is capable of securing the thermal insulation block, thereby inhibiting lateral movement between the thermal insulation block and the cleat. The threaded fastener can be configured to secure the metal roof panel, the cleat, and the thermal insulation block to the metal purlin.

In another embodiment, a method of installing an insulated metal roof is provided. The method includes the steps of arranging a plurality of metal purlins in a substantially parallel configuration such that voids exist between the metal purlins, disposing a thermal insulation block on top of the metal purlin, disposing a cleat on top of the thermal insulation block, disposing a metal roof panel on top of the cleat, and securing metal roof panel, cleat, and thermal insulation block to the metal purlin with a threaded fastener. The cleat used in the method has a protrusion which secures the thermal insulation block and inhibits lateral movement between the thermal insulation block and the cleat.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
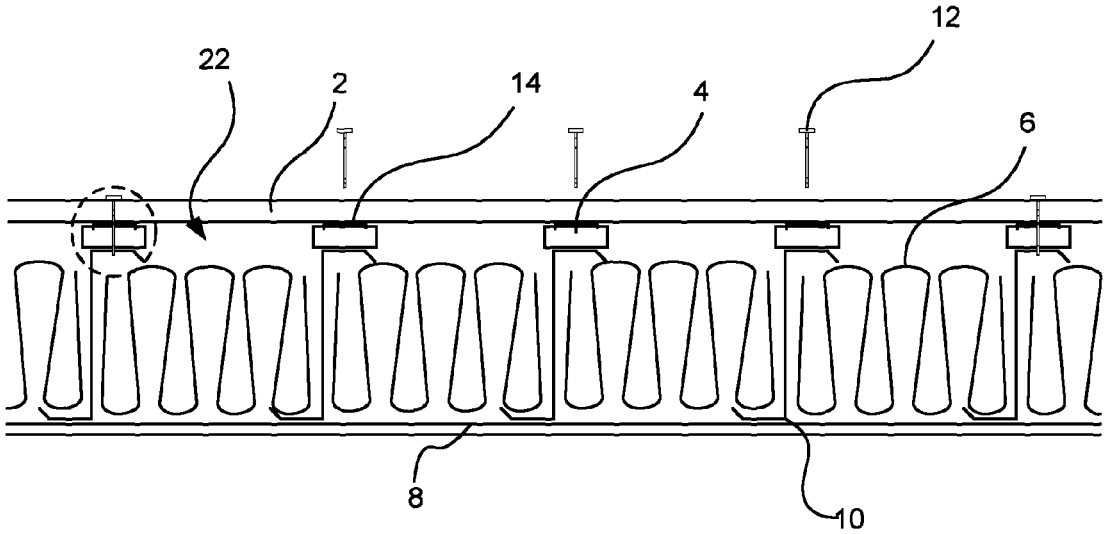
FIG. 1 is a cross-sectional view of a insulated roof installed using an embodiment of the methods and systems of the present invention.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a purlin" includes one or more of such purlins, and reference to "a thermal insulation block" includes reference to one or more of such blocks.

DEFINITIONS

In describing and claiming the present invention, the following terminology will be used in accordance with the definitions set forth below.

As used herein, the term "threaded fastener" refers to any fastening device or combination of devices which incorporates an at least partially threaded cylinder as a component of the device. Non-limiting examples of such devices include screws, bolts, and the like. Typically, self-tapping metal screws are used in connection with the present invention.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

EMBODIMENTS OF THE INVENTION

The present invention teaches both a system and related method for installing and insulating metal roofs. FIG. 1 shows one embodiment of the system of the present invention. This insulated roof deck system includes metal purlins 10, metal roof panels 2, thermal insulation blocks 4, cleats 14, threaded fasteners 12, and insulation 6. The metal purlins 10 are configured to be arranged in a parallel or substantially parallel array such as shown in FIG. 1. When the purlins are disposed in the parallel array, voids 22 exist between the purlins. The purlins used in the systems and methods of the invention can be made of any metal or metal alloy including but not limited to steel, alloys of steel, aluminum, and others. The purlins can take any form known in the art including, but not limited, to I-beams, Z-shaped (shown in FIG. 1), C-shaped, tubular, or boxed purlins. As is known in the art, the purlins form the primary structural support for the roof structure. As such the purlins are typically attached to a vertical support, e.g. side walls and/or center supports.

Optionally, the voids 22 between the metal purlins 10 can be filled with insulation 6. The insulation can be any type of insulation known in the art such as fiberglass. In one embodiment, the insulation 6 can be configured to be secured by the threaded fastener 12 between the metal roof panel 2 and the metal purlin 10. In another embodiment, the insulation 6 can be supported by support rails 8. The support rails 8 can be configured to span the voids between the metal purlins 10 and can be secured to the metal purlins. The support rails can also add to the structural support of the roof system and typically run substantially perpendicular to the purlins.

The metal roof panels 2 can form the outer roof deck of the roofs made using the methods and systems of the present invention. As with the purlins 10, the metal roof panels can be made of any metal or metal alloy known in the art, including but not limited to steel, alloys of steel, aluminum, tin, and the like. The metal roof panels can be interlocking, corrugated, or of any other design or configuration known in the art. When installed, the metal roof panels 2 can be attached to the metal purlin by threaded fasteners 12.

In the systems of the present invention, the thermal insulation blocks can be disposed between the metal roof panel 2 and the metal purlin 10 so as to reduce or substantially prevent the transfer of heat between the metal roof panel 2 and the metal purlin 10. The thermal insulation blocks 4 can be made of any insulative material known in the art including, but not limited to polystyrene, polyisocyanurate, polyurethane, mixtures thereof, and the like. The thermal insulation blocks 4 can be any size or shape so long as they form an insulative layer between the metal roof panels 2 and the metal purlins 10. Typically, the insulation block can be an elongated block which substantially coincides with a longitudinal upper surface of the metal purlin.

In one embodiment, the system can optionally include an adhesive layer disposed between the thermal insulation block 4 and the cleat 14, the thermal insulation block and the metal purlin 10, or both. The adhesive layer facilitates the construction or assembly of the insulated roof. For example, when the adhesive layer is present between the thermal insulation block and the metal purlin, the thermal insulation block is held in place with respect to the metal purlin until the entire system can be secured using the threaded fasteners 12.

Figure 2:
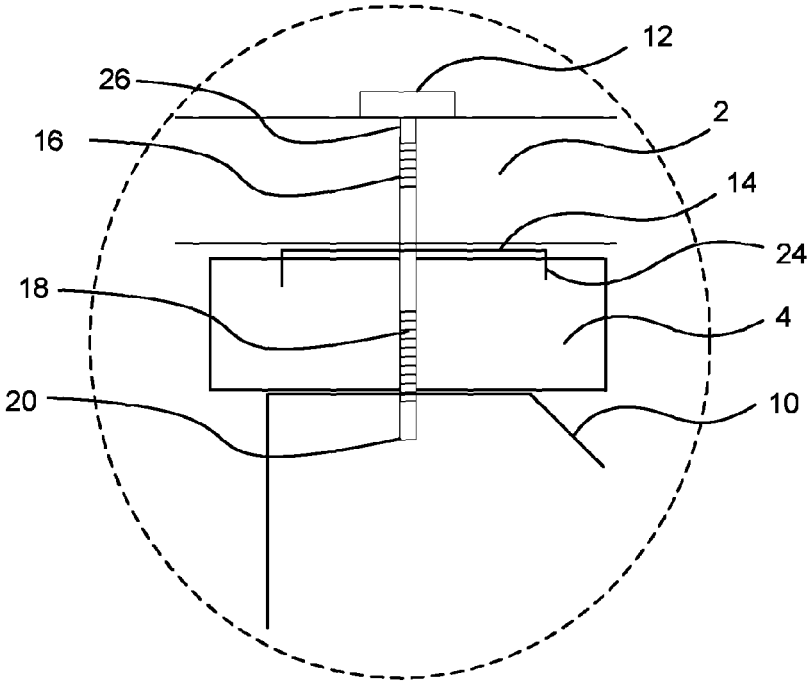
FIG. 2 is a blow-up of the outlined corresponding region of FIG. 1.

In order to reduce or prevent lateral movement between the metal roof panel 2 and the thermal insulation block 4, the systems of the present invention include cleats 14 which can be disposed between the thermal insulation block 4 and the metal roof panel 2. FIG. 2 shows an exploded view of the dashed region in FIG. 1 and illustrates in greater detail on embodiment of the cleat 14 and its relationship to the other components in the system. The cleats 14 can have a protrusion 24, or multiple protrusions, which are configured to secure the thermal insulation block 4 when placed in contact therewith. In the embodiment shown in FIG. 2 the protrusion on the cleat secures the thermal insulation block by penetrating the block (penetrating protrusion). These protrusions engage the insulation block sufficient to reduce lateral or offset movement between the metal roof panel and the metal purlins.

The cleats 14 can come in a variety of shapes and sizes and can be made of any material so long as the material is sufficiently ridged and strong to inhibit lateral movement of the thermal insulation block or between the thermal insulation block and the metal roof panel when the cleat is installed. In one embodiment, the cleat can be made from a metal. In another embodiment, the cleat can be a U-shaped piece of metal, the protrusions corresponding to the two ends of the "U." In this embodiment, when the U-shaped cleat 14 is inverted, the two ends or protrusions 24 can penetrate the thermal insulation block 4 and inhibit lateral movement of the block, or between the block and the metal roof panels 2. In one embodiment, the protrusions on the cleat can be serrated to facilitate embedding the edges into the block. In each case, the cleats and blocks extend substantially the length of the purlin to which they are attached. This can be accomplished using a single block-cleat assembly or multiple such assemblies oriented in series to achieve the desired length.

Figure 4:
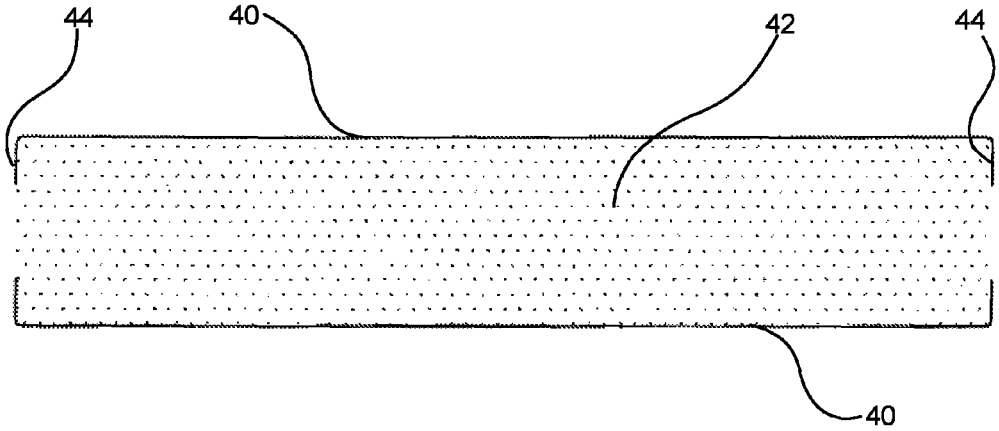
FIG. 4 is cross-sectional side view of one embodiment a cleat and thermal insulation block that can be used in the present invention.

FIG. 4 shows an alternative cleat-block assembly which can be used in the systems of the present invention. Specifically, FIG. 4 shows an embodiment in which metal cleats 40 cap opposing sides of a thermal insulation block 42, effectively sandwiching the thermal insulation block. Like the metal cleat of FIG. 2, the metal cleats shown in FIG. 4 include protrusions 44 which secure the thermal insulation block against lateral movement. The protrusions of the embodiment shown in FIG. 4 secure the thermal insulation block by confining the block between the protrusions (confining protrusions). Like the penetrating protrusions, the confining protrusions engage the insulation block sufficient to reduce lateral or offset movement between the metal roof panel and the metal purlins.

It is noteworthy that, although the cap-style cleats may be used in pairs (e.g. FIG. 4), such pairing of the cleats is not required. Although not shown, in one embodiment, the cleat can include both penetrating protrusions and confining protrusions. In another embodiment, the system can include one cleat with penetrating protrusions and one cleat with confining protrusions.

The thermal insulation block and cleat assembly can be manufactured independently and combined together during construction of the roofing system. Alternatively, the thermal insulation block and cleat can be manufactured together and included as an integrated component in the roofing systems. For example, a pair of cleats can be spaced apart and oriented relative to one another as desired in a final assembly. An insulating precursor material can be blow molded or otherwise injected into the space between the cleats. Optional adhesive layers can be formed to secure the insulation against the cleats, depending on the inherent cohesiveness between the materials. During molding a plastic film can be oriented across an outer side space between opposing protrusions to prevent insulation flowing outside of the assembly. Alternatively, excess insulation can be sliced from the sides, e.g. using a heated wire, blade or saw. Generally, any manufacturing process known in the art can be used so long as the resultant thermal insulation block and cleat integrated component can perform the desired function of insulating the purlins against thermal transfer.

When installed, the roofing systems of the present invention can optionally include insulation layers between the metal roof panels and the cleats. Such insulation can be standard 2-4 inch insulation. During assembly, insulation areas between the roof panels and cleats will be pinched and compressed ⅜ inch or less.

The components of the insulated metal roofs made from the systems and methods of the present invention can be secured together using threaded fasteners 12. Specifically, the threaded fasteners used in the system are configured to secure the metal roof panel 2, the cleat 4, and the thermal insulation block 4 to the metal purlin 10. Generally, any type of threaded fastener or threaded fastener system can be used. Non-limiting examples include screws and blots.

Figure 3:
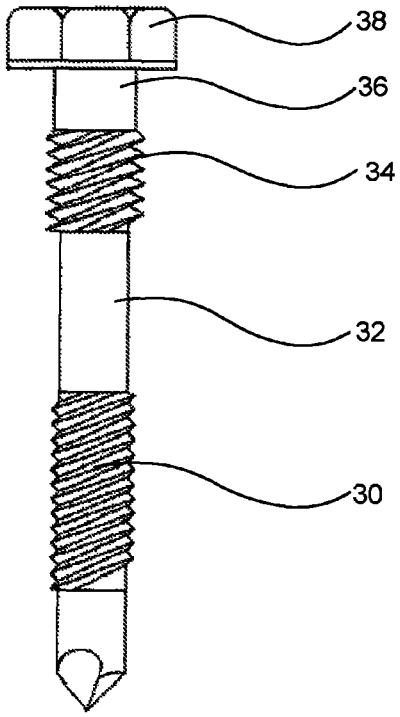
FIG. 3 is a side schematic of a threaded fastener of the present invention.

Because the thermal insulation block 4 can be relatively soft, over-tightening of the threaded fasteners can cause the thermal insulation block to become completely or partially crushed, thereby reducing the insulative value provided by the thermal insulation block. Similarly, insulation which is placed between the roof panels 2 and the cleats 14 can be pulled up through the roof panel if over-tightened. In order to prevent over-tightening of the threaded fastener 12, in one embodiment, the threaded fastener 12 can have a first threaded region 20 and a second threaded region 16 which are separated by an unthreaded region 18. (See FIG. 2) The length of the unthreaded region 18 of the threaded fastener 12 can correspond to the thickness of the thermal insulation block. The position of the fastener 12 is shown partially engaged. The system can be assembled such that the threaded fastener is disposed such that the unthreaded region is substantially located within the thermal insulation block. The threaded fastener can optionally include a second unthreaded region 26 proximate the fastener head. This second unthreaded region can correspond to a minimum desired thickness of the roof panel and pinched insulation combined, including optional washers. In this way splaying of the roof panel metal immediately around the fastener shaft can be reduced or eliminated while also avoiding pulling insulation up through the roof panel. FIG. 3 shows another embodiment of the above described threaded fastener. The fastener includes a first threaded region 30, a first unthreaded region 32, a second threaded region 34, and a second unthreaded region 36, each region having similar characteristics to the corresponding regions of the fastener shown in FIGS. 1 and 2. The fastener shown in FIG. 3 also includes a hexagonal head 38 which facilitates quick and easy installation. Furthermore, the upper second threaded region can be narrower than the lower first threaded region such that once engaged in the roofing system, the second threaded region is below the roof sheet and upper cleat. In this way, the second threaded region and the first unthreaded region are embedded in the thermal insulation block. Similarly, upon engagement, the first threaded region is through the purlin opposite the insulation block.

Although the specific geometries can vary, in one aspect, the first unthreaded region can have a length of about 7/16" to about 5/8" and in one aspect about 9/16". These dimensions can vary depending on the stem length (e.g. 2" versus 1.5") and the corresponding roof system dimensions. In a further aspect, as shown in FIG. 3, each of the upper and lower threaded regions can have a different width. For example, the upper second threaded region 34 (including optionally the stem) can have a width which is subtly larger than a width of the lower first threaded region 30. Generally, the difference can be from about 1/64" to about 1/32"; however, the width difference can generally be merely sufficient to ensure that the second threaded region is securely engaged with the roof material. In particular, as the first threaded portion cuts through the roof segment some give (or play) may be left between the threads and the cut hole. By providing slightly wider threads in the second region, any such play can be substantially reduced or eliminated.

All embodiments of the systems of the present invention can be used in accordance with the related method. In one embodiment, a method of installing an insulated metal roof is provided which includes the steps of arranging a plurality of metal purlins in a substantially parallel configuration such that voids exist between the metal purlins, disposing a thermal insulation block on top of the metal purlin, disposing a cleat on top of the thermal insulation block, disposing a metal roof panel on top of the cleat, and securing metal roof panel, cleat, and thermal insulation block to the metal purlin with a threaded fastener. The cleat used in the method has a protrusion which secures the thermal insulation block and inhibits lateral movement between the thermal insulation block and the cleat. Optional support rails 8 can be mounted substantially perpendicular the purlins 10 spanning the spaces 22. The steps can be performed in the order set forth above, although assembly can occur in various sequences. Furthermore, optional insulation layers can be oriented and laid between the roof panels and the optional support rails.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. An insulated roof deck system, comprising:

a plurality of metal purlins, each metal purlin being configured to form a parallel array of purlins such that voids exist between the metal purlins in the parallel array;

a plurality of metal roof panels, each panel being configured to be attached to the metal purlins to form a roof deck;

a plurality of thermal insulation blocks, each thermal insulation block being disposed between the metal purlin and the metal roof panel;

a first cleat configured to cap a side of the thermal insulation block and disposed between the thermal insulation block and the metal roof panel, and a second cleat oriented opposite the first cleat to sandwich the thermal insulation block, wherein each cleat includes a protrusion which secures the thermal insulation block and inhibits lateral movement between the thermal insulation block and the cleat; and a threaded fastener, wherein the threaded fastener is configured to secure the metal roof panel, the first cleat, the second cleat, and the thermal insulation block to the metal purlin.

2. A system as in claim 1, wherein the voids between the metal purlins are filled with insulation.

3. A system as in claim 2, wherein the insulation is supported by support rails which are configured to span the voids between the metal purlins and to be secured to the metal purlins.

4. A system as in claim 2, wherein the insulation can be configured to be secured by the treaded fastener between the metal roof panel and the metal purlin.

5. A system as in claim 1, wherein the system includes an adhesive layer which is configured to be disposed between the thermal insulation block and at least one of the cleats.

6. A system as in claim 1, wherein the first and second cleats are u-shaped.

7. A system as in claim 1, wherein the protrusions on the first and second cleats penetrate the thermal insulation block.

8. A system as in claim 1, wherein the threaded fastener has a first threaded region and a second threaded region which are separated by an unthreaded region.

9. A system as in claim 8, wherein the thermal insulation block has a thickness and the unthreaded region of the threaded fastener has a length which corresponds to the thickness of the thermal insulation block.

10. A method of installing an insulated metal roof, comprising:

arranging a plurality of metal purlins in a substantially parallel configuration such that voids exist between the metal purlins;

disposing cleats about opposite sides of a thermal insulation block to sandwich the thermal insulation block, each of said cleats being configured to cap a side of the thermal insulation block and having a protrusion which secures the thermal insulation block and inhibits lateral movement between the thermal insulation block and the cleat;

disposing the cleat on one side of the thermal insulation block on top of the metal purlin;

disposing a metal roof panel on top of the cleat on the opposite side of the thermal insulation block; and securing the metal roof panel, the cleats, and the thermal insulation block to the metal purlin with a threaded fastener.

11. A method as in claim 10, wherein the steps are performed in the order set forth in claim 10.

12. A method as in claim 10, wherein the method further includes the step of disposing insulation in the voids between the metal purlins.

13. A method as in claim 12, wherein the method includes securing support rails to the metal purlins such that the support rails span the voids between to the metal purlins and support the insulation, wherein the insulation is also disposed between the metal roof panel and the metal purlin.

14. A method as in claim 10, further comprising disposing an adhesive layer between thermal insulation block and at least one of the cleats.

15. A method as in claim 10, wherein the cleats are u-shaped.

16. A method as in claim 10, wherein the protrusions on the cleats penetrate the thermal insulation block.

17. A method as in claim 10, wherein the threaded fastener has a first threaded region and a second threaded region which are separated by an unthreaded region and wherein the thermal insulation block has a thickness and the unthreaded region of the threaded fastener has a length which corresponds to the thickness of the thermal insulation block such that the unthreaded region is substantially disposed in the thermal insulation block.

18. A system as in claim 1, wherein the first cleat, the second cleat, and the insulation block extend substantially the same length as the metal purlin.

* * * * *